United States Patent [19]

Pratt et al.

[11] Patent Number: 4,572,406

[45] Date of Patent: Feb. 25, 1986

[54] AEROSOL CONTAINER AND VALVE ASSEMBLY FOR AUTOMATICALLY SIGNALLING DEPLETION OF A PREDETERMINED AMOUNT OF THE CONTAINER CONTENTS WHEN IN AN INVERTED POSITION

[75] Inventors: David C. Pratt, Kirkwood; James J. Albanese, Jr., Eureka, both of Mo.

[73] Assignee: Seachem, a division of Pittway Corp., Cary, Ill.

[21] Appl. No.: 472,478

[22] Filed: Mar. 7, 1983

[51] Int. Cl.[4] ..... B67D 5/32; B65D 83/06

[52] U.S. Cl. ..... 222/39; 222/402.19; 222/464; 239/342

[58] Field of Search ..... 222/23, 39, 64, 211, 222/376, 382, 394, 402.16–402.19, 464, 564, 481; 239/71, 72, 337, 342

[56] References Cited

U.S. PATENT DOCUMENTS

| | | | |
|---|---|---|---|
| 2,924,360 | 2/1960 | Samuel | 222/402.19 |
| 2,968,428 | 1/1961 | Samuel | 222/402.19 |
| 3,545,488 | 12/1970 | Venus, Jr. | 137/590 |
| 4,371,098 | 2/1983 | Nozawa et al. | 222/376 X |
| 4,475,667 | 10/1984 | Ori et al. | 222/39 |

FOREIGN PATENT DOCUMENTS

| | | | |
|---|---|---|---|
| 2058229 | 4/1981 | United Kingdom | 222/402.19 |

*Primary Examiner*—Joseph J. Rolla

*Assistant Examiner*—Michael S. Huppert

*Attorney, Agent, or Firm*—Dressler, Goldsmith, Shore, Sutker & Milanamow, Ltd.

[57] ABSTRACT

Disclosed herein is an improved aerosol assembly which may be used inverted and upright and which, when used in the inverted position, will automatically provide an audible signal that a predetermined amount of the container contents has been depleted. A valve body defining a hollow interior and a base has a hollow diptube operatively connected to the valve body interior and reaching at its lower end to the bottom of an associated aerosol container. A moveable valve stem is provided for placing the valve body interior in communication with the exterior of the aerosol container. A liquid level spray control is provided and defines a control opening positioned between the valve body base and the diptube lower end. The opening is positioned no closer to the valve body base than 20% of the distance between the base and the diptube lower end and no farther from the base than 80% of the distance between the base and the diptube lower end. The control opening is in open flow communication with the valve body interior when the aerosol container and associated valve assembly are in their inverted position. A valve having a ball for automatically sealing the control opening from communication with the valve body interior when said aerosol container and valve assembly is in an upright position is provided.

6 Claims, 7 Drawing Figures

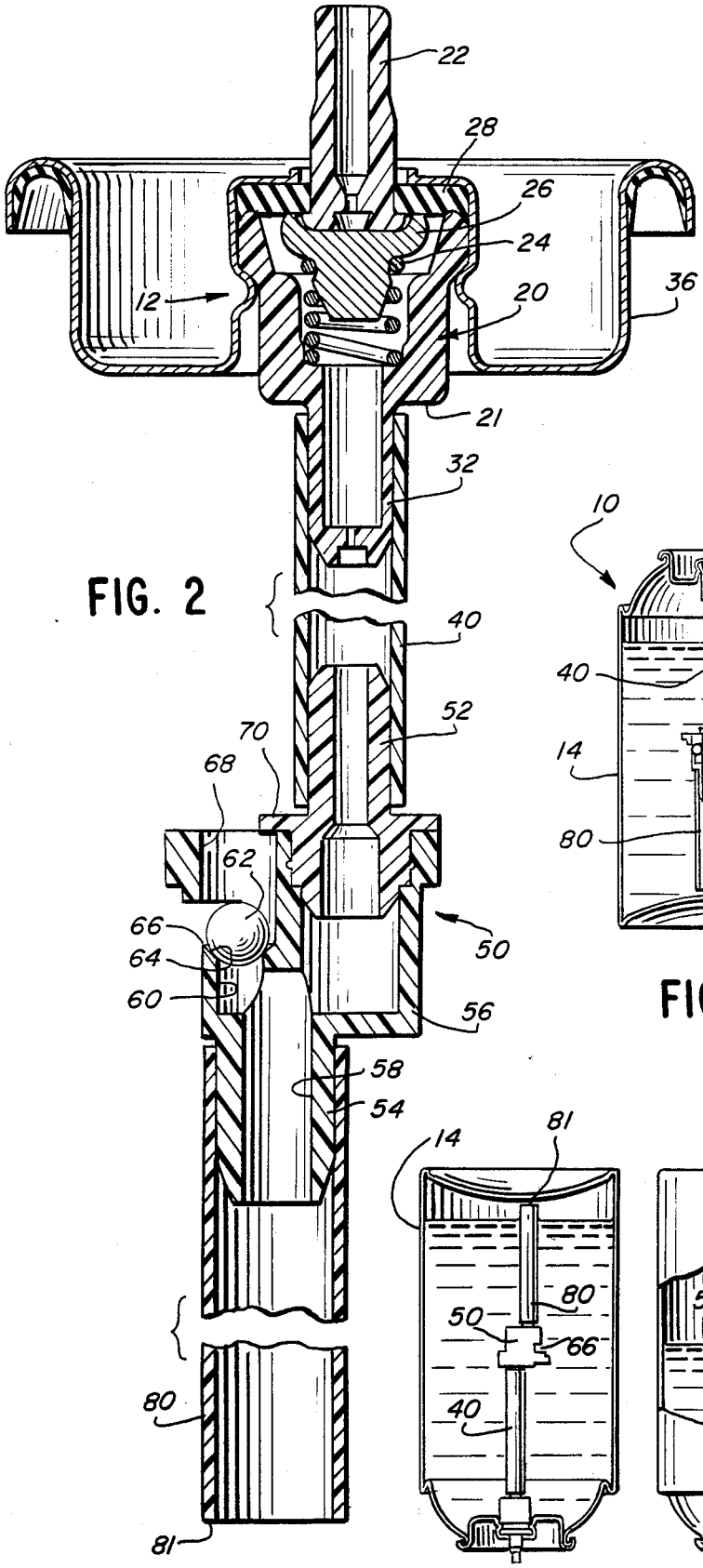
FIG. 2
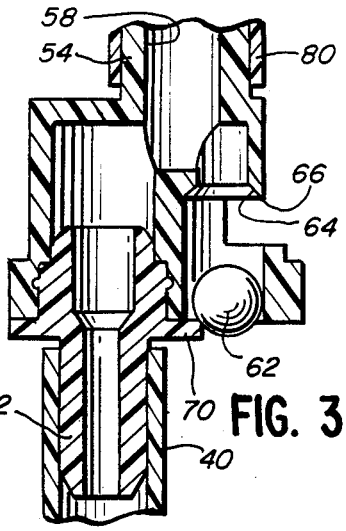
FIG. 3
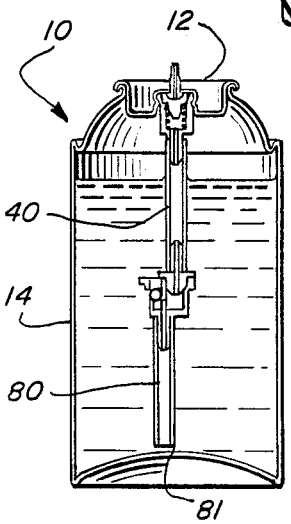
FIG. 1
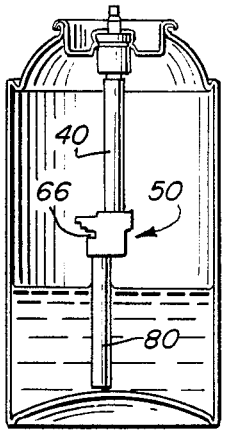
FIG. 4
FIG. 5
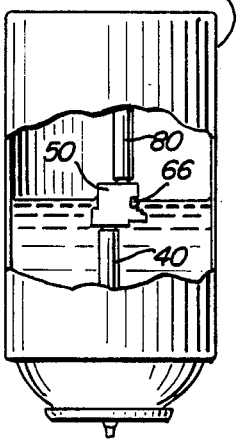
FIG. 6
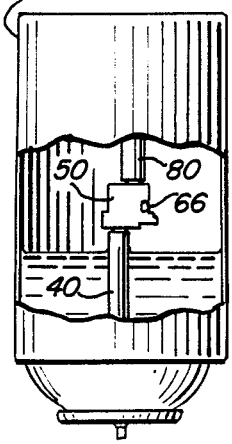
FIG. 7

AEROSOL CONTAINER AND VALVE ASSEMBLY FOR AUTOMATICALLY SIGNALLING DEPLETION OF A PREDETERMINED AMOUNT OF THE CONTAINER CONTENTS WHEN IN AN INVERTED POSITION

FIELD OF THE INVENTION

This invention relates to an improved aerosol assembly which may be used inverted and upright and which, when used in the inverted position, will automatically provide an audible signal that a predetermined amount of the container contents has been depleted.

BACKGROUND OF THE INVENTION

Various types of aerosol packages are presently available. Some are intended for continuous spraying or fogging. Some are provided primarily for upright use. Still others are intended both for upright and inverted use. The nature of the valving supplied with a particular aerosol package depends upon the principle purpose or purposes for which the contents are to be used and the orientation of the container in which the user is likely to use it.

One increasingly important use for aerosols is in the control and eradication of insects, such as fleas. When rooms in homes are to be sprayed for fleas, the preferred practice is to provide a concentrated spray in corners, along edges of the floor, in cabinets and on affected carpet areas. This, of course, requires a spray valve which will discharge intermittent conventional streams or bursts with the container preferably in an inverted position. The treatment of affected areas additionally preferably requires fogging, i.e., the continuous discharge of a substantial portion of a container into an enclosed area, such as in a closed room. Of course, the user should not remain in the area as that is done. Accordingly, special available continuous spray actuator assemblies are available for this purpose. It is very important that certain minimum amounts of materials to be dispensed from an aerosol container should be dispensed in the continuous mode.

At present, although valving assemblies are available for each of these purposes, there is none available which will enable a user to be certain that the minimum amount necessary for effective fogging of a given room area (as pursuant to EPA requirements) will be available after some of the contents have been used for spot or intermittent spraying. To be certain that a predetermined amount will be available, the user must purchase and use two separate containers. Also, because there is no way in which a user can be certain the minimum amount for fogging will be available, labelling requirements restrict the freedom of aerosol insecticide packagers to promote a single package for combined intermittent and continuous use.

It is with an aerosol package that will automatically provide a positive and readily perceived signal that the remaining portion of the container contents should be discharged in the continuous, fogging mode with which the invention of this application is concerned.

SUMMARY OF THE INVENTION

The present invention provides an aerosol container and valve assembly which is inexpensive and adapted to signal automatically, when used in an inverted position, that the remaining contents of the container should be discharged in the upright, continuous, fogging mode.

The aerosol container itself may be conventional. The valve assembly comprises, in addition to conventional gaskets, actuators and the like generally known to be the minimum elements necessary to effect aerosol discharge in an upright manner, a valve body defining a hollow interior and a base, a hollow diptube operatively connected to the valve body interior and adapted to reach, at its lower end, to the bottom of the aerosol container, and a moveable valve stem for placing the valve body interior in communication with the ambient atmosphere.

In accordance with the present invention, there is provided a liquid level spray control means defining a control opening positioned between the valve body base and the dip tube lower end. The control opening is positioned no closer to the valve body base than 20% of the distance between the base and the lower end. The control opening is in open flow communication with the valve body interior when the aerosol container and associated valve assembly are in the inverted posiiion.

In a preferred construction, the control means further comprises valve means for automatically sealing the control opening from communication with the valve body interior when the aerosol container and valve assembly are in an upright position. The valve means may comprise a valve seat and a ball valve which is seated on the seat in the upright position.

The control means may mount the diptube, in which event a spacer tube is connected to the valve body and it is the control means which operatively connects the diptube to the valve body. In one embodiment, the diptube lower end is in flow communication with the valve body interior in all positions of the aerosol container and valve assembly. Preferably the control opening is disposed in the mid-region between the diptube lower end and the valve body base.

Further objects, features and advantages of this invention will become apparent from the following description and drawings.

BRIEF DESCRIPTION OF THE DRAWINGS

FIG. 1 is a view of an aerosol container and valve assembly of this invention showing a typical liquid level for the contents of the package as sold;

FIG. 2 is an enlarged cross-sectional view of the aerosol valve and control assembly of FIG. 1;

FIG. 3 illustrates the liquid level spray controller in the inverted position;

FIG. 4 shows the container of FIG. 1 in a partially discharged condition during its continuous discharge or fogging mode;

FIG. 5 is a view of the container of FIG. 1 in an inverted position;

FIG. 6 is a view of the container of FIG. 5 in which the liquid level is at an elevation at which a user is being signalled that the continuous spray mode is then timely; and FIG. 7 is a view of the container of FIG. 4 in a position in which a constant signal would be provided that the continuous spray mode should have already been initiated.

DESCRIPTION OF THE PREFERRED EMBODIMENT

Referring now to the preferred embodiment of the present invention, a package 10 of this invention comprises a preassembled aerosol valve 12 adapted to be secured to a container 14. The aerosol valve may be of a known, conventional type, and may comprise a plastic valve body 20 with a tubular valve stem 22 and a valve closing means such as a spring 24. A conventional valve actuator, not shown, such as a conventional spray button with a dispensing orifice, may be used to actuate the valve in a known manner.

Spring 24 biases a valve seat 26 against a gasket 28, thereby to seal the interior of the body from the exterior of the container 14, except when the valve stem is operated. The valve body terminates in a tailpiece 32 adapted to mount dip tubing.

The valve body 20 is crimped to a mounting cup 36 which in turn is crimped to an aerosol can or container of any desired conventional kind. When the can is to be used, the valve stem 22 via the associated actuator is tilted, which in turn tilts valve seat 26, placing the interior of the can, through tailpiece 32, valve body 20, and the longitudinal passageway in valve stem 22 with the atmosphere. It will be appreciated that both male and female valve constructions may be used.

The tailpiece of the valve assembly is provided with a depending spacer tube 40. Spacer tube 40 in turn is secured with the liquid level spray control means such as spray controller 50. Controller 50 comprises a connector 52 which secures the controller to the spacer tube 40, and a tailpiece 54 which defines a primary contents receiving opening 58. A depending diptube 80 is secured to tailpiece 54. The controller further comprises a hollow main body portion 56 which normally provides communication between the spacer tube 40 (hence the valve body 20) and the lower end of the container. Thus when container 14 is upright and aerosol valve 12 is actuated, liquid is discharged.

As stated, the aerosol package 10 of this invention is also designed to operate in an inverted position, but for discharging only a controlled amount of the container contents in the liquid phase in that position. Thus, liquid level spray controller 50 includes an auxiliary valve which controls communication between an auxiliary contents receiving opening 60 and the valve body 20. In the upright position of the container, opening 60 is closed by a movable valve member, such as a ball 62 which sealingly rests on a valve seat 64 defined by controller 50. When the can is inverted, as shown in FIG. 3, the ball drops from the seat 64 and opening 60 is placed in communication with the interior of the can through adjacent primary control opening 66, and control opening 68 in the controller 50. To retain the ball in an inverted position, a stop 70 is provided. Of course only one control opening of suitable size is necessary, and the placement of the control opening may depend upon factors such as molding convenience and efficiency.

When the can is in the inverted position, flow communication is thus provided both between the diptube 80 and the valve body 20 and the opening 60 of the valve body. For intermittent inverted use, and until the controlled amount of the contents is discharged, the portion of the contents discharging will be the liquid phase since opening 60 will be in direct communication with valve body 20. Further, the relatively large volume in the diptube 80 and the proportioning of the control openings 66, 68 will tend to promote only liquid flow to the valve body in the inverted position until, of course, the inverted liquid level descends to the level of the control opening 66.

At that time, the gas phase in the container will be placed in direct communication with the main body portion 56 and the valve body 20, and the user will experience a readily perceivable signal by the change from liquid phase to gas phase discharge from the container. This signals the fact that the predetermined percentage of the contents of the container has been discharged so that the remainder of the contents should be discharged in the upright fogging mode At that time, the user should then discontinue any inverted intermittant use, should return the can to the upright position which again causes the ball to seat on valve seat 64, closing off communication of the valve body 20 with control openings 66, 68. The user should then complete the use of the container in the upright fogging mode, during which time the contents pass upwardly through the diptube 80 until the liquid contents are exhausted and the last of the pressurized gaseous phase is exhausted as well.

It will be apparent that the amount of the product dispensed before the user is automatically signalled that the fogging mode should be initiated will be determined by the location of the lowermost gas phase control opening in the upright position (the uppermost gas phase control opening in the inverted position in the embodiment illustrated is primary opening 66). The preferred location is such that at least about 50% of the contents will be reserved for spraying in the fogging mode. Under some circumstances it may be desirable to reserve as much as 75% or more of the contents for discharge in the fogging mode.

Thus, the primary control opening 66 is desirably located in the mid-region or about halfway between the base 21 of the valve body 20 and the lower end 81 of the diptube 80. If the level of the liquid fill in the container is substantially below the base 21 of the valve body 20, then the primary control opening 66 should be disposed about midway between the upper liquid level of the initial fill and the lower end of the diptube. In either case, the primary control opening should be located no higher than 20% of the distance between those points and no lower than 80% of the distance between those points, i.e., no closer to the valve body base than 20% of the distance between the base and the lower end and no farther from said base than 80% of the distance between the base and the lower end.

A specific use of the present invention is for flea control and extermination. At present, in some parts of the country, flea infestation has become almost epidemic. In treating rooms and associated carpeting and cabinetry and the like, consumers purchase aerosol cans of insecticides formulated to exterminate fleas. The preferred practice is to discharge part of the contents downwardly, as in corners and on carpets, and then to use a continuous fogging spray actuator to discharge the remainder of the contents in a closed room with the user absent from the room.

In an embodiment of the present invention for that purpose, a suitable mechanical break-up actuator is used in the initial phase discharge. Thereafter, for the continuous fogging mode, a suitable total release actuator is used.

In one example, a container itself may be a $7\frac{1}{2}$ liquid ounce can having a height of about $5\frac{1}{2}$ inches. The liquid level in the can before use is approximately $4\frac{3}{4}$ inches. The primary control opening 66 is positioned at about 3 inches below the level of the base of the valve body and about $2\frac{1}{4}$ inches below the level of the liquid phase when the container is in the upright position.

Thus, when about 35 to 40% of the liquid contents have been discharged, the very different sound of gas discharging, rather than liquid discharging, will automatically signal the user that the remainder of the contents should be discharged in the upright, fogging mode.

From the foregoing, it will be observed that numerous variations and modifications may be effected without departing from the true spirit and scope of the novel concept of the invention. It is to be understood that no limitation with respect to the specific embodiments illustrated herein is intended or should be inferred. It is, of course, intended to cover by the appended claims all such modifications as fall within the scope of the claims.

What is claimed is:

1. An aerosol container and aerosol valve assembly for automatically signalling, when used in an inverted position, that a predetermined amount of the contents of said aerosol container has been discharged, said valve assembly comprising a valve body defining a hollow interior and a base, a hollow diptube operatively connected to said valve body interior and reaching at its lower end to the bottom of said aerosol container, a moveable valve stem for placing said interior in communication with the exterior of said aerosol container, and liquid level spray control means defining a control opening positioned between said valve body base and said diptube lower end, said opening being positioned no closer to said valve body base than in the mid-region of the distance between said base and said lower end and no farther from said base than 80% of the distance between said base and said lower end, said control opening being in open flow communication with said valve body interior when said aerosol container and valve assembly is in the inverted position.

2. An aerosol container and aerosol valve assembly in accordance with claim 1 wherein said control means further comprises valve means for automatically sealing said control opening from communication with said valve body interior when said aerosol container and valve assembly is in an upright position.

3. An aerosol container and aerosol valve assembly in accordance with claim 2, wherein said valve means comprises a valve seat and a ball valve which is seated on said seat in said upright position.

4. An aerosol container and aerosol valve assembly in accordance with claim 3 wherein said diptube is mounted on said control means, and further comprising a spacer tube, said spacer tube being connected to said valve body and said control means, and said control means operatively connects said diptube to said valve body.

5. An aerosol container and aerosol valve assembly in accordance with claim 1 wherein said diptube lower end is in open communication with said valve body interior in all positions of said aerosol container and valve assembly.

6. An aerosol container and aerosol valve assembly in accordance with claim 1 wherein said control opening is disposed in the mid-region between said diptube lower end and said valve body base.

* * * * *